US005927362A

United States Patent [19]

Smiley et al.

[11] Patent Number: 5,927,362

[45] Date of Patent: Jul. 27, 1999

[54] WINDOW CORNICE ASSEMBLY

[75] Inventors: Charles F. Smiley, Waunakee; Mark Gilbertson, Sauk City; John Grosz, Columbus, all of Wis.

[73] Assignee: Springs Window Fashions Divisions, Inc., Middleton, Wis.

[21] Appl. No.: 09/022,081

[22] Filed: Feb. 11, 1998

[51] Int. Cl.[6] ..... E04F 10/00

[52] U.S. Cl. ..... 160/38; 160/39; 160/378; 160/381

[58] Field of Search ..... 160/19, 38, 39, 160/378, 381; 52/656.9, 708; 403/205, 283

[56] References Cited

U.S. PATENT DOCUMENTS

| | | | |
|---|---|---|---|
| 1,343,209 | 6/1920 | Gwyer | 403/283 |
| 1,392,070 | 9/1921 | Maiers | 403/283 |
| 1,402,304 | 1/1922 | Lord | 403/283 |
| 2,243,222 | 5/1941 | Rebholz | 160/38 |
| 2,342,893 | 2/1944 | Purcell et al. | 160/38 |
| 2,375,247 | 5/1945 | Rebholz | 160/38 X |
| 2,501,133 | 3/1950 | Levy | 160/38 X |
| 2,565,588 | 8/1951 | Bruno | 160/38 |
| 3,606,419 | 9/1971 | Virkler et al. . | |
| 4,662,421 | 5/1987 | Basmadji et al. . | |
| 4,935,988 | 6/1990 | Ford et al. | 160/38 X |
| 5,042,548 | 8/1991 | Attal . | |
| 5,219,013 | 6/1993 | Rozon . | |
| 5,259,687 | 11/1993 | John . | |
| 5,505,245 | 4/1996 | Badalamenti . | |
| 5,597,025 | 1/1997 | Forkner . | |
| 5,598,880 | 2/1997 | Cross . | |

FOREIGN PATENT DOCUMENTS

| | | | |
|---|---|---|---|
| 500109 | 6/1930 | Germany | 160/39 |
| 1164615 | 3/1964 | Germany | 160/38 |

*Primary Examiner*—Blair M. Johnson
*Attorney, Agent, or Firm*—Lerner, David, Littenberg, Krumholz & Mentlik, LLP

[57] ABSTRACT

A window cornice assembly is disclosed. The window cornice assembly may comprise a front section and two side sections upon which fabric may be arranged. Corner pieces may be mounted on the front and side sections. Fabric may be arranged and secured on the front and/or side sections by clips that retain the fabric taut and over the front face thereof. The clips can be attached to each other directly by an elastic cord or band, or attached to the rear face of the front section directly so that the fabric is tightly pulled over the front face of the front section. The elastic cord or band imparts a desired amount of elasticity to the fabric. The window cornice assembly may have one or more elongated channel-shaped support strips arranged on a front section to provide additional rigidity thereto.

17 Claims, 7 Drawing Sheets

1
110
26
74
74
10
80
99
26
60
10
W 62
65
64
76
68
74
74
63
70
65
60
78
66
72

65
122
120
60
123
68
121
63
65
84
65
63
66
72
65

WINDOW CORNICE ASSEMBLY

FIELD OF THE INVENTION

The present invention relates to window treatments. More particularly, the present invention relates to window cornice assemblies having a corner piece which may be assembled to hold the sides and the front of a window cornice together.

BACKGROUND OF THE INVENTION

Window valences, headrails, or cornices are all assemblies that attach to the top of windows to create a decorative appearance or serve functional purposes when used in combination with blinds, curtains, shades or other window treatment devices. For the purposes of this discussion, valences, headrails, and cornices are equivalent apparatus, and will be collectively referred to as window cornices or, simply, a cornice. Window cornices are often covered with fabric to enhance the decorative appearance is thereof or to match or complement other window coverings or decor in the room.

One problem that must be addressed by cornice manufacturers is that windows and the moldings that surround them are not uniform in width. Windows come in an almost infnite variety of sizes and shapes. Therefore, manufacturers often produce and stock various sizes of cornices or custom-made cornices for each window. But stocking various sizes of window cornices consumes a substantial amount of wholesale and retail shelf-space. Moreover, no matter how many sizes are stocked, the selection would still not cover the almost infinite range of window sizes.

Prior art methods of manufacturing custom sized cornices are both expensive and time consuming. Therefore, great effort has been expended by inventors to make window cornices that may be adjusted to various window sizes. However, these known cornices and cornice assemblies are complicated to adjust, require tools to assemble, are expensive and time consuming to manufacture, or do not otherwise meet the needs of the consumers for adjustable window cornices.

For example, U.S. Pat. No. 1,952,069 to Hoffheimer et al., U.S. Pat. No. 2,315,033 to Adair, U.S. Pat. No. 2,539,380 to Ziemmerman, and U.S. Pat. No. 5,597,025 to Forkner, each disclose a telescoping cornice assembly to adjust the width of the cornice. However, these disclosed assemblies and other known telescoping cornices have a is limited range of adjustment, are relatively complicated to manufacture, and do not provide for the easy attachment of window fabric.

Other cornices are known that use an adjustable internal rod, known in the industry as a "curtain rod" or "pocket-rod," such as those sold under the brand name Dauphine rod, upon which a fixed length fascia board is attached. U.S. Pat. No. 5,039,049 to Niemi and U.S. Pat. No. 5,505,245 to Badalamenti disclose cornices using such an internal rod. However, these internal rods must be covered by a fascia piece. And since the fascia piece itself requires adjustment to fit varying window widths, the disclosures in these patents do not solve the basic problem of creating an easily adjustable finished window cornice. In addition, in known cornices employing an internal rod covered by a fascia piece, once the internal rod is covered by the fascia piece, the internal rod becomes difficult to access, therefore making it difficult for the user to adjust the window cornice.

It is also known in the art to provide a multi-piece headrail with interlocking parts that may be added or removed to expand or contract the cornice width. One example of this type of cornice is disclosed in U.S. Pat. No. 4,828,002 to Levy. However, this disclosure includes a complex adjustment mechanism and is therefore not desirable.

In addition, a number of cornices employ a unitary headpiece that may be cut to fit a desired window width. Such cornices are often not desirable because the method of adjusting the length of the headrail requires a saw or other tool to cut the headrail, and some modicum of experience to achieve a straight cut. Further, the existing cornices that require assembly of the front section to the side sections using this method of adjustment have heretofore employed complicated corner joint members which require external tools and remote securing devices, such as nails or the like, to join the headrail to the two side rails. This increases manufacturing time and thus the cost of the assembly. Various cornices are disclosed that incorporate a mechanism for attaching such front and side cornice pieces. These include U.S. Pat. No. 3,606,419 to Virkler et al., U.S. Pat. No. 4,662,421 to Basmadji et al., U.S. Pat. No. 4,828,002 to Ashbyto, U.S. Pat. No. 5,033,525 to Paeselt, and U.S. Pat. No. 5,042,548 to Attal. Each of these disclosures employ either complicated molds, cannot be cheaply manufactured, or cannot be easily adapted to cornices having an adjustable front piece as described above.

Finally, as noted above, customers often desire to cover their cornice with fabric to create a decorative appearance which may match or complement other window coverings or general room decor. Various ways are known to secure fabric to window cornices including the use of staples, tacks or the like. These methods suffer from damaging the fabric and being difficult to remove or replace. Moreover, these methods do not account for eventual stretching of the fabric over time, thus allowing wrinkles to develop which decrease the appearance of the fabric. U.S. Pat. No. 5,217,784 to Shepherd, U.S. Pat. No. 5,219,013 to Rozon, and U.S. Pat. No. 5,598,880 to Cross, each disclose assemblies for attaching fabric to a window cornice. However, neither of these assemblies allow the fabric to be neatly wrapped around the entire cornice where the fabric is provided with a desired degree of elasticity. In addition, the known adjustable cornices, employing complicated clips, corner pieces and adjusting means do not present a flat uniform exterior to the window cornice, thereby preventing the smooth wrapping of fabric around the cornice.

Therefore, there exists the need for an improved adjustable window cornice assembly to overcome the shortcomings discussed above with existing window cornices.

SUMMARY AND OBJECTS OF THE INVENTION

The present invention addresses the shortcomings of the prior art by providing a comer piece having a plurality of spikes securing a front section of a cornice to a side section thereof. One advantage of such a comer piece is that the window cornice can be assembled without the use of tools. The present invention allows both professional window cornice installers and homeowners to easily adjust and install a window cornice. The present invention covers the window cornice itself with front and side sections, in varying embodiments as described below, and the corner piece, per se, for use with a window cornice, also in various embodiments as described below.

In a preferred embodiment of the present invention, a window cornice is provided with a front section and two side sections. The two side sections space the front section of the window cornice at a desired distance from the wall. At least one corner piece having a plurality of spikes may be provided. To connect the two side sections of the cornice to the front section of the cornice, each corner piece may be used to connect the front section of the window cornice to one of the side sections. In a preferred embodiment where the front and side sections are made of foam or similar material, the corner pieces can be secured into assembled position within the front and side sections of the window cornice by hand pressure alone which forces the spikes to extend into the front and respective side sections. In a preferred embodiment of this invention, each of the spikes are tapered. Such tapering allows the spikes to more easily pierce the surface of the respective front and side sections of the cornice. In the embodiment where the corner piece is molded to form an integral component, such tapering aids in the release of the corner piece from the mold.

In one of the preferred embodiments, the window cornice is supplied with at least two corner pieces so that both side pieces can be connected to the front piece. For more stability, four corner pieces can be used so that the top and bottom of each side section is connected to the top and bottom of the front section. However, as noted above, it should be appreciated that four corner pieces are not necessary to practice the invention. The present invention is directed to a single corner piece alone and a window cornice assembly in combination with one or more corner pieces to connect a front section to side sections thereof.

In another preferred embodiment, the corner piece is provided with an L-shaped support member having a plurality of spikes extending perpendicular to the plane of the support member. This embodiment allows the corner piece to conform to window cornices where the side sections are attached substantially perpendicular to the front section, as is common in practice. An additional advantage of the corner piece employing an L-shaped support member is that the front and side can be held securely at a 90° angle, which is often desired by those using window cornices. However, it should be noted that other preferred embodiments of the support member may be provided, each having a differently shaped support member for securely holding the front and side members together at a desired angle.

In another preferred embodiment, the corner piece is provided with an elongate base having two parallel sides extending perpendicular to the base, thus forming a channel. In this preferred embodiment, the front or side sections fit between the parallel sides of the channel to securely hold the front and side sections together. This channel may be sized to fit snugly onto the width of the front and side sections, thereby more securely holding the respective side sections to the front section of the cornice.

In yet another embodiment, the parallel sides of the corner pieces fit so securely onto the front and side sections that the plurality of spikes employed in other preferred embodiments are not required. In a further embodiment, the inside surfaces of the sides of the corner piece have have raised ribs or protrusions to increase the friction fit of the corner piece onto the window cornice.

Preferably the corner piece is made of polymeric material and may be integrally molded. Such polymeric materials include but are not limited to, plastic or polyvinyl chloride materials.

In another preferred embodiment, a support strip is included to increase the stability of the front section of the window cornice. This support strip can be placed on either or both the top or bottom surfaces of the front section. In a further embodiment, multiple support strips are provided, with at least one such support strip attached to the top of the front section and another attached to the bottom of the front section. The use of two support strips increases the stability of the window cornice, but is not necessary to practice the invention.

This support strip is preferably a substantially flat member with parallel sides running its length, thereby forming a long channel-shaped configuration. The channel of the support strip may be sized to fit snugly onto the width of the front section, thereby imparting more stability to the front section.

In a further preferred embodiment of the support strip, the substantially flat member is made of a resilient and flexible material and constructed in a fashion whereby the substantially flat member has a slight radius thus causing the substantially parallel sides to deflect at a slight acute angle towards each other. In accordance with this embodiment of the invention, when a support strip is placed upon the top or bottom of the front section of a window cornice the sides of the support strip are securely clamped onto the front section. The tension thus imparted to the support strip facilitates the more secure attachment of the support strip to the front section, thereby imparting additional stability to the front section.

It should be appreciated that in various embodiments of the present invention, the support strip can be secured to the front section of the window cornice by adhesives, tapes, screws, pins, spikes or other protrusions, whether integral to the support strip or provided separately. In a preferred embodiment of the invention, the support strip is made of a molded polymeric material.

In another preferred embodiment, the front section of the window cornice has an elongate central recess extending lengthwise end to end. The central recess may be sized to accept a curtain rod, which as discussed above, is known in the trade for attaching window cornices to the wall above a window. In this embodiment, the central recess can be formed in a dovetail shape so that the curtain rod can be pressed into the recess by hand pressure and will be secured within the central recess without any further means of attachment. Structures other than this dovetail shape may also be used to achieve a pressure-fit connection between the curtain rod and the front section of the cornice. In other preferred embodiments, the side sections of the cornice may also have an elongate central recesses adapted to fit upon a curtain rod. Those side sections may be further adapted in additional embodiments to allow for such curtain rod to be pressure fit within such central recess by using the above described dovetail shaped recess or other methods. Such pressure fit of the curtain rod to the front and side sections allows the front and side sections to be removed from above the window without removing the curtain rod. In another preferred embodiment, the side sections are provided with an access passageway such as a channel, a hole, or the like, to allow access to the internal rod so that the curtain rod may be adjusted relative to the wall without removing the front or side sections from such curtain rod.

In another preferred embodiment of the invention, the front and side sections of the window cornice are made out of a foam material. Various advantages may be observed through the use of a foam material. For example, a foam window cornice assembly is easy to work with given its substantially rigid and lightweight structure. Further, components such as the corner pieces of the present invention can be easily secured into foam without additional tools. Still further, foam assemblies are more readably customizable (e.g. adjustable) as discussed below.

In another preferred embodiment of this invention, the front section of the window cornice has one or more preweakened sections allowing the front section to be split widthwise into two pieces. This preweakened section may be provided in a number of ways, including partially perforating a portion of the front section, or manufacturing the front section in a way that the thickness in one area is decreased to allow the front section to be split at such thin area. These are only examples of how preweakened strips may be made as there are many other known methods for preweakening a section of a structural component. The object of the preweakened section is to allow portions of the front section to be removed without the use of tools, such as saws and the like, therefore altering the length of the front section so it may be adjusted to fit varying window widths.

In another preferred embodiment of this invention, the front section of the window cornice is comprised of two parts, each part having one or more preweakened sections. An advantage of having a front section comprised of two parts is that each part is adjustable to allow an increased range of adjustability of the window cornice. An additional advantage of this embodiment is to reduce the length of the front section so that it may be is efficiently packaged and shipped. In another preferred embodiment of this invention, the front section can be provided with separate additional front pieces thereby further increasing the possible length and range of adjustability of the window cornice.

In a further embodiment of this invention, a series of adjacent preweakened sections can be provided in either the single piece or two piece front sections, each preweakened section having a specific width such as 1" wide. Users of the cornice could thus remove a predetermined quantity of the preweakened sections depending on the amount they wanted to reduce the length of the front section. For example, if one wanted to reduce the length of the cornice by four inches, the user need only remove four one inch preweakened sections. This embodiment allows the user to adjust the size of the window cornice without tools or measuring devices. This embodiment can be manufactured in various lengths, allowing retailers to stock only a few window cornice sizes, each adjustable for a specific range of window widths.

In a further embodiment of this invention, the preweakened sections can be provided in a range of sizes, thereby allowing fine adjustment of the window cornice. For example, such an embodiment of the front section could employ a series of ¼", ½", ¾" and 1" preweakened sections, thereby allowing a wide variety of adjustments to the length of the front section.

In the embodiment of the invention employing the preweakened sections, the support strip in the embodiments described above is used to bridge two separate pieces of the single piece front section or the two parts of the two piece front section thereby facilitating a stable arrangement between the pieces of the front section after they have been sized for a specific window. In the preferred embodiment of the invention employing separate additional front section pieces, the support strip facilitates the connection of these additional pieces to the front section. The support strip also allows the user to reattach subsections of the front section that have been broken off at the preweakened sections, whether by mistake in measurement or breakage of the front section.

In another embodiment of the invention, the side pieces of the window cornice are also adjustable by providing one or more preweakened portions as described above. Providing easily adjustable side sections allows the window cornice to be custom-fit so that the front section can be spaced a desired distance from the wall or window frame on which the cornice assembly is mounted.

In another preferred embodiment of the invention, the front face and top and bottom surfaces of the front and side sections have recesses in which the corner piece and/or support strip are arranged when fully assembled. These recesses are preferably sized and located to facilitate placement of the corner piece and support strip on the front and side sections without protruding beyond the face thereof. In a further embodiment of this invention, the window cornice assembly can be provided with thick adhesive tape or other material of approximately the same dimension as the depth and width of the side recess, so that any part of the recess not covered by the corner piece or support strip can be filled in with such tape or other material.

In another embodiment of the invention, a clip or elastic assembly is provided to attach fabric to the window cornice. Preferably, a plurality of clips are employed wherein one clip is attached to one end of the fabric and a second clip is attached to another end of the fabric. The fabric is placed over the front and sides of the window cornice and the clips are secured adjacent the back face of the front section. The clips can be attached to the back of the cornice or to each other, thus holding the fabric taut over the front face of the window cornice.

In another preferred embodiment of the invention, two fabric clips can be held together by elastic means. Such means can include flexible fabrics, elastic bands, elastic cords such as those commonly known as bungee cords, or springs. Any of these means can be used in the preferred embodiment to impart a degree of elasticity to the fabric wrapped around the cornice. This elasticity allows the fabric to remain tightly stretched around the window cornice, thereby reducing wrinkles or sagging and increasing the aesthetic appearance of the cornice. The clips also allow the fabric to be easily removed from the window cornice for cleaning of the fabric or cornice pieces and then as easily replaced. Another advantage of having an elastic band or other elastic means to secure the fabric to the window cornice is that less accuracy is required in cutting the fabric to fit the cornice, thereby making it easier for the user to fit the fabric to the window cornice.

It is an object of the present invention to provide a window cornice that enables a person without carpentry skills to put a window cornice together without the use of tools or complicated mechanisms.

It is another object of the invention to provide an adjustable window cornice that can be adjusted by a person without carpentry skills to fit varying window widths without the use of tools or complicated mechanisms.

It is still another object of the invention to provide an apparatus that allows fabric or other material to be easily and quickly wrapped around a window cornice in a way that the fabric is held tautly onto the cornice, allows easy removal of the fabric from the window cornice, and imparts a degree of elasticity to the fabric to prevent it from wrinkling.

These and other features, objects and advantages of the present invention will be more readily understood when viewed in conjunction with the following detailed description of the preferred embodiments and the drawings of the present invention.

DETAILED DESCRIPTION OF THE PREFERRED EMBODIMENTS

Figure 1:
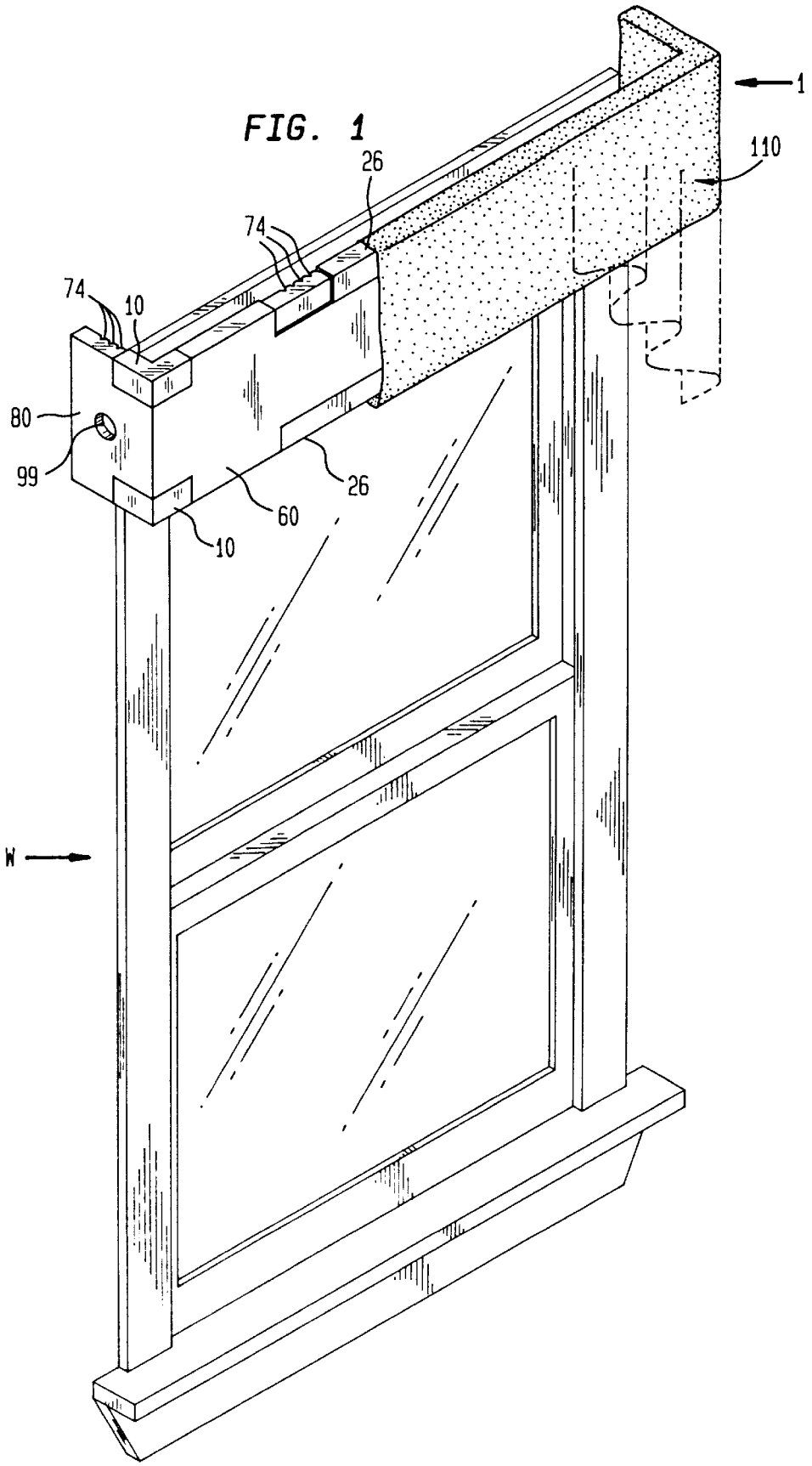
FIG. 1 is a front perspective cut-away view of one embodiment of the present window cornice assembly arranged in place over a window.
Figure 2:
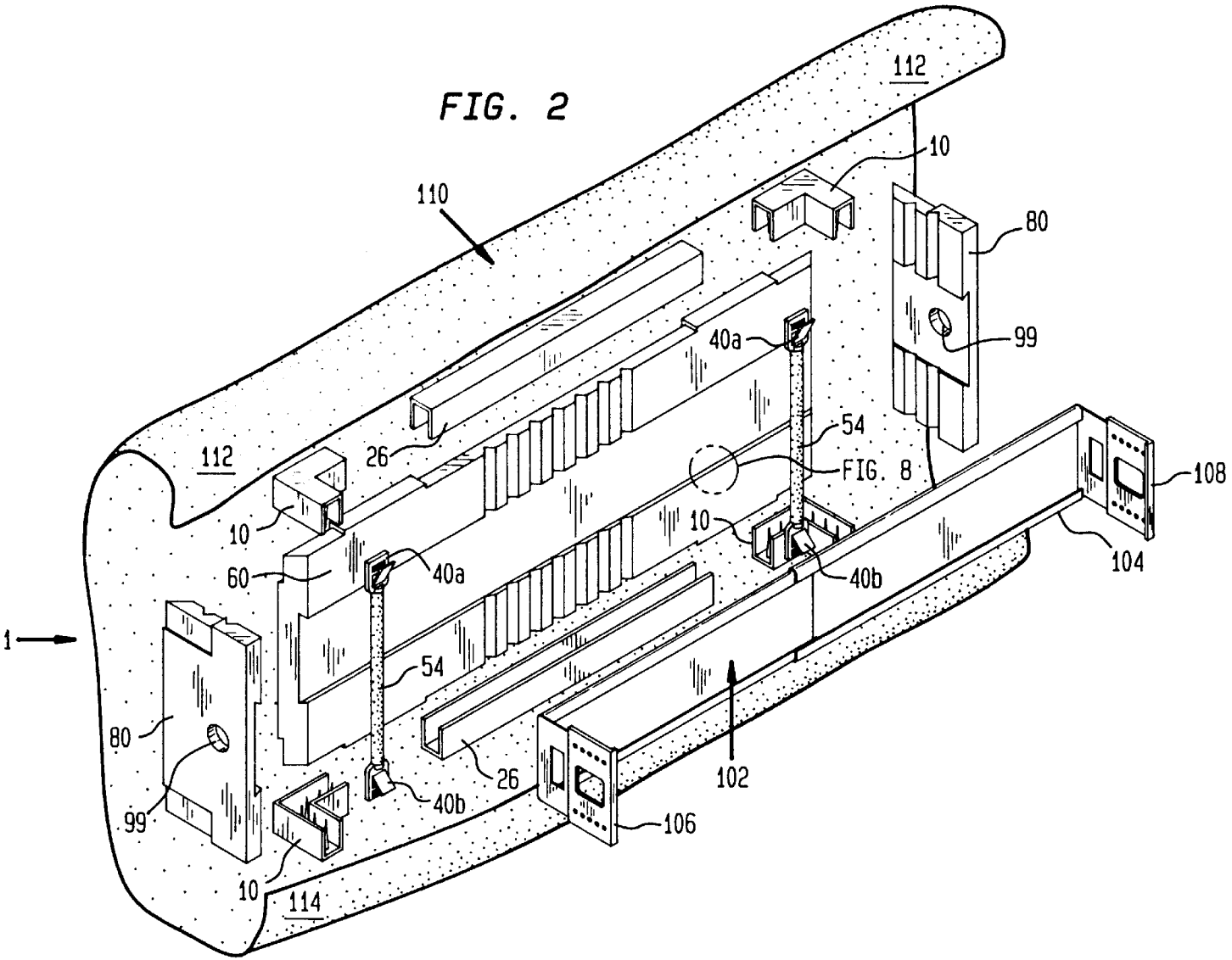
FIG. 2 is rear perspective exploded view of one embodiment of the present window cornice assembly.

A window cornice assembly generally designated 1 is shown in FIGS. 1 and 2 having an adjustable front section generally designated 60 and a pair of opposing adjustable side sections generally designated 80 attached to the front section 60 at opposing ends thereof.

Figure 3:
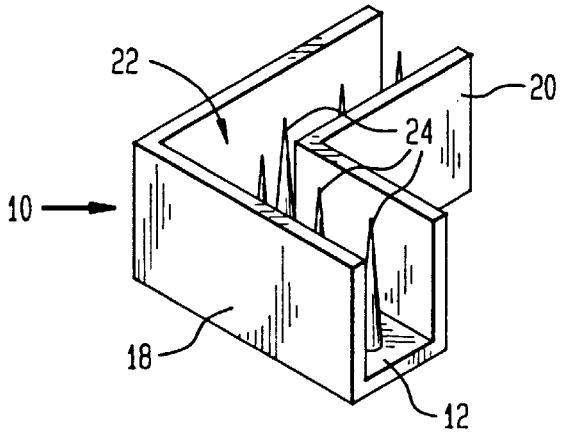
FIG. 3 is a perspective view of one embodiment of a corner piece of the present invention.
Figure 4:
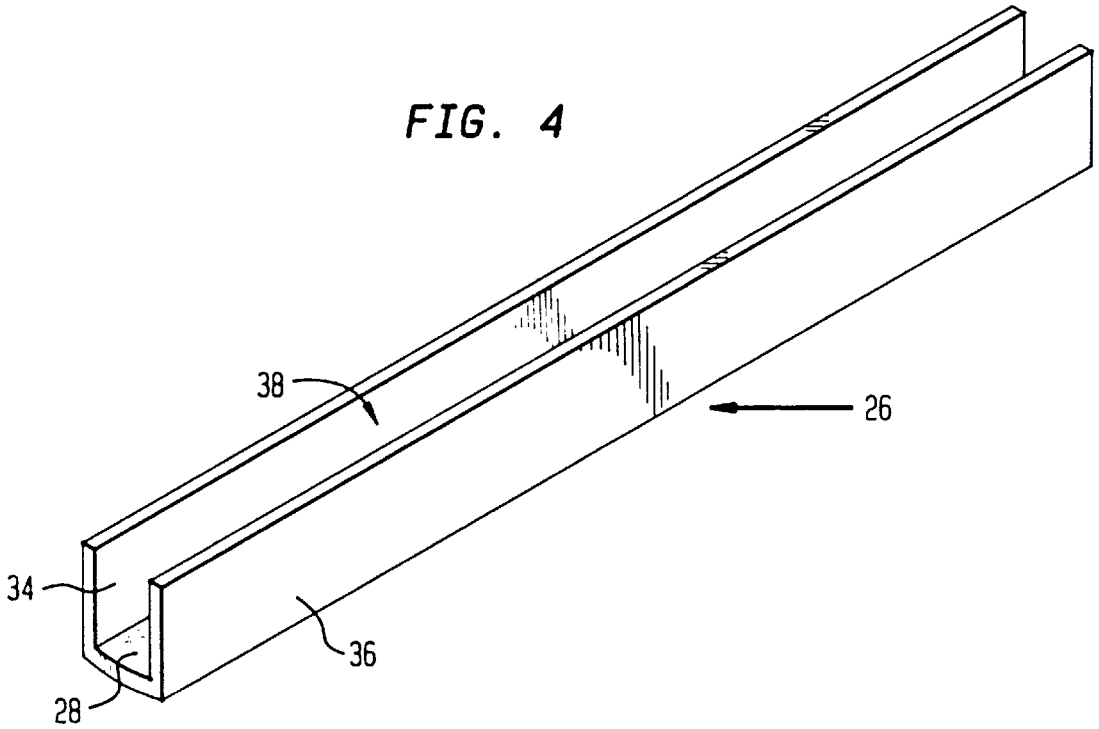
FIG. 4 is a perspective view of one embodiment of a support strip of the present invention.

As clearly shown on FIGS. 1, 2, 6A and 6B, the front section 60 includes a first side surface 66, an opposing second side surface 68, and opposing top surface 70 and bottom surface 72 extending along the length of the front section 60 between the first and second side surfaces 66 and 68. The front section 60 includes a front face 62 and a rear face 64. A corner recess 65 is provided in the top surface 70 and the front face 62 of the front section 60 at each of the first side surface 66 and second side surface 68. A similar corner recess 65 is provided in the bottom surface 72 and the front face 62 of the front section 60 at each of the first side surface 66 and second side surface 68. Such corner recesses 65 are sized to accept corner pieces 10, as shown in FIGS. 1, 2 and 3, and described below, such that the corner pieces 10 do not extend past the plane of the front face 62, the top surface 70, or the bottom surface 72 of the front section.

In addition, in this preferred embodiment, a middle recess 63 is provided in the top surface 70 and the front face 62 substantially between the first side surface 66 and second side surface 68. A similar middle recess 63 is provided in the bottom surface 72 and the front face 62 substantially between the first side surface 66 and second side surface 68. Such recesses 63 are sized to accept support strips 26, as shown in FIGS. 1, 2 and 3, and described below, such that the support strip 26 does not extend past the plane of the front face 62, the top surface 70, or the bottom surface 72 of the front section. An advantage of the corner recesses 65 and middle recesses 63 is to provide a smooth finished appearance to the exterior of the window cornice when fabric 110, as described below, is wrapped around the front section.

Figure 6A:
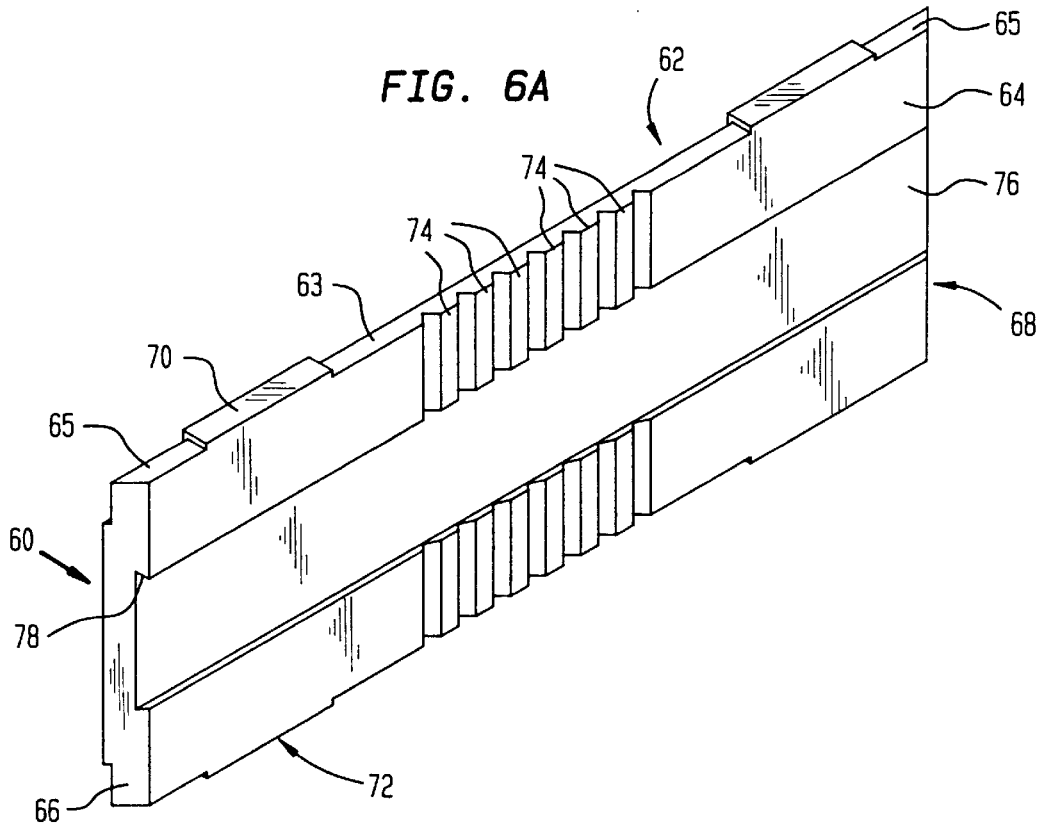
FIG. 6A is a rear perspective view of one embodiment of a front section of the window cornice assembly.
Figure 6B:
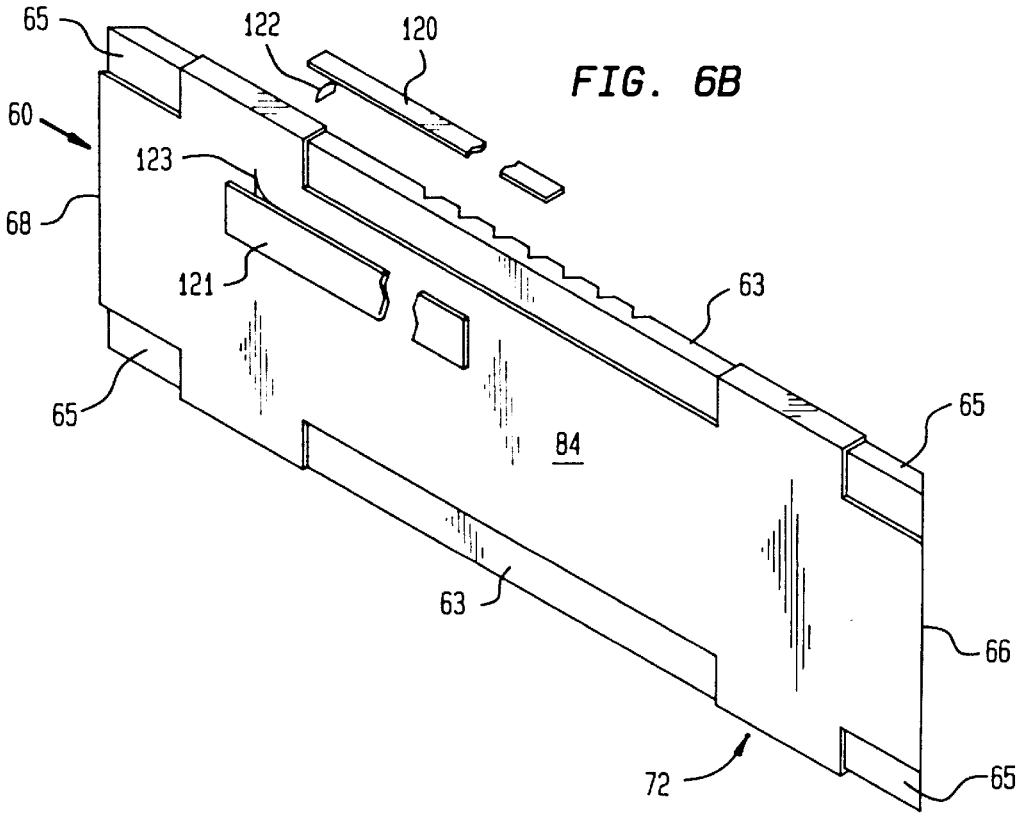
FIG. 6B is a front perspective view of one embodiment of a front section of the window cornice assembly.

As clearly shown in FIG. 6B, in the preferred embodiment of the window cornice employing a depression 63 to accept a support strip 26, tape pieces 120 and 121 are provided to fill in any portion of the depressions not covered by the support strip. The tape pieces may have an adhesive backing 122 and 123 and in a preferred embodiment are approximately the same thickness as the material of the support strip 26. The tape piece 120 to cover the top surface portion of depression 63 is of the approximate width of the front section. The tape piece 121 to cover the front face portion of depression 63 is of the approximate width of the side of the support strip 26 that is placed adjacent to the front face of the front section.

Figure 8:
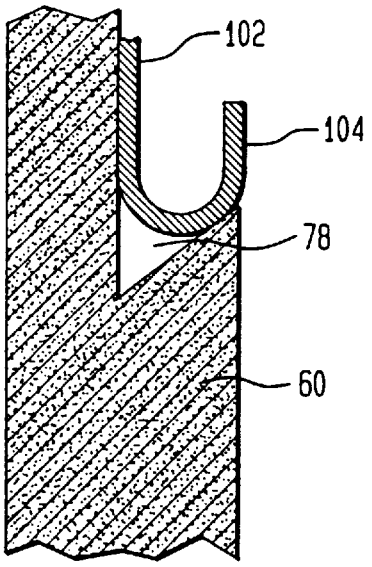
FIG. 8 is a vertical cross-sectional view of the front section of the window cornice assembly shown in FIG. 1, where a Continental Rod is shown in assembled position.

Also in this preferred embodiment, a recess 76 extends lengthwise along the rear face 64 and is sized to fit onto a curtain rod 102, or other mounting member, which is commonly used in the trade to support an adjustable window cornice assembly. As shown in FIG. 8, recess 76 includes parallel top and bottom edges 78 formed in an angled dovetail shape so that the front section 60 can be secured on the curtain rod 102 in a friction fit relationship.

In the preferred embodiments, the front section 60 is made of a foam material. However, the front section 60 may also be made of many other suitable materials such as wood, plastic, cardboard, metal, or the like, sufficiently rigid to maintain their shape when secured above a window.

Figure 9:
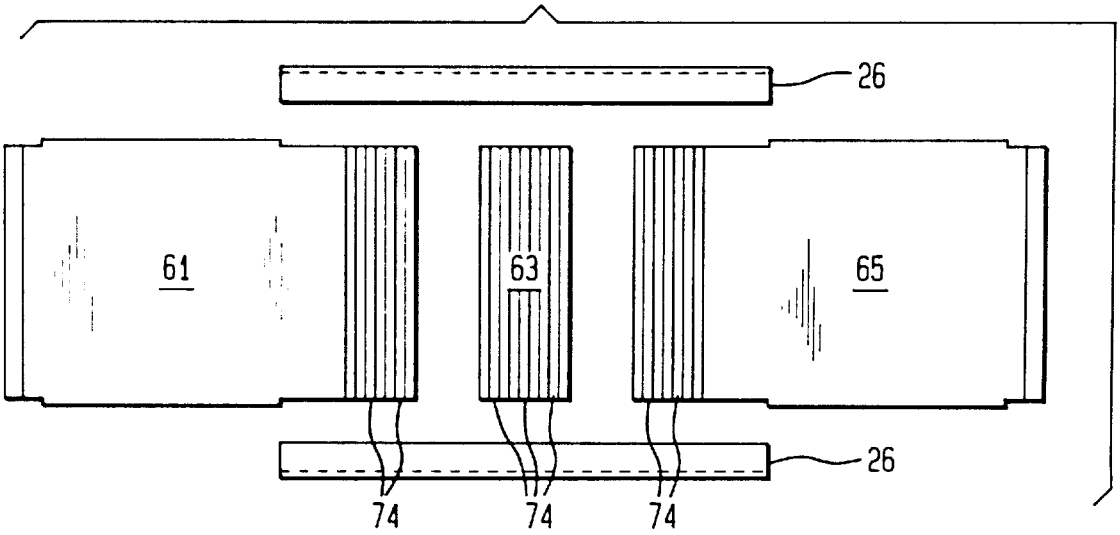
FIG. 9 is a partially disassembled schematic view of the front section of the window cornice illustrating the length of the front section of the window cornice assembly being adjusted as a central portion thereof is shown disassembled from the remainder of the front section.

In a preferred embodiment, as shown in FIGS. 1, 2, 6A, 6B and 9, the front section 60 is provided with a series of preweakened strips 74 which extend between the opposing top and bottom surfaces 70 and 72. These preweakened strips 74 are useful for customizing the overall length of the front section 60. For example, each preweakened strip may be one inch wide. If a person desired to reduce the length of the front section 60 of the cornice assembly by three inches, three support strips 74 can easily be removed as illustrated by center subsection 63 in FIG. 9. The front section 60 would thus be separated into a first subsection 61 and a second subsection 65. When the central subsection 63 is removed, subsection 61 is abutted to subsection 65 and the support strip 26 arranged upon the top surface 70 thereof as describe below thereby holding the subsections 61 and 65 of the front section 60 together. This allows the front section 60 to be adjusted in width without the use of tools to custom-fit the cornice to a variety of window sizes. FIG. 9 shows the front section with subsections 61, 63, and 65 separated for illustrative purposes. In use, after the middle subsection 63 has been separated from the front section, the two remaining subsections 61 and 65 would be arranged to abut each other. It should be appreciated that the preweakened sections 74 may be fashioned in a variety of ways, depending on the nature of the materials, the number and width of the sections desired to be separable, and the method of manufacture used to create the preweakened sections.

Figure 7A:
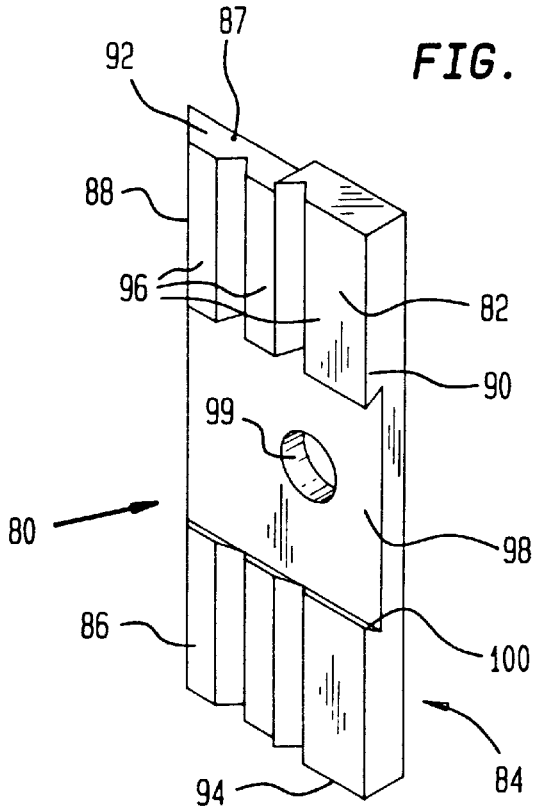
FIG. 7A is a rear perspective view of one embodiment of a side section of the window cornice assembly.
Figure 7B:
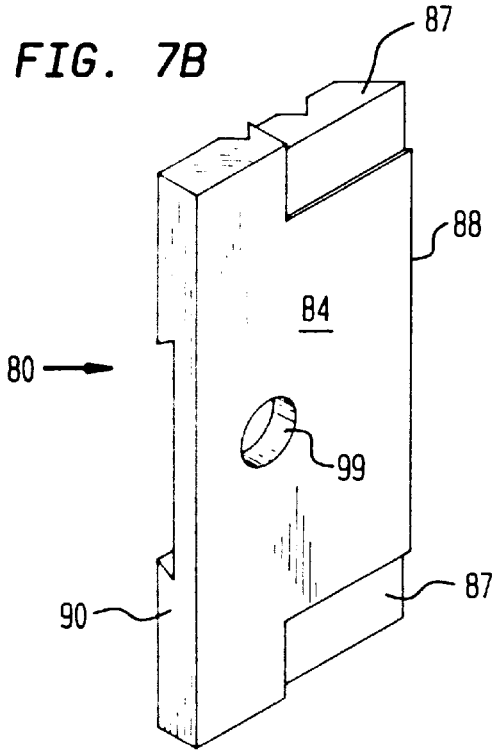
FIG. 7B is a front perspective view of one embodiment of a side section of the window cornice assembly.

As best shown in FIGS. 2, 7A and 7B, each of the side sections 80 include a first side surface 88, an opposing second side surface 90, and opposing top surface 92 and bottom surface 94 extending along the length of the side section 80 between the first and second side surfaces 88 and 90. Each side section 80 also includes a front face 84 and a rear face 86. A recess 98 extends lengthwise along the rear face 86 and is sized to fit onto a curtain rod 102, or other mounting member to support an adjustable window cornice assembly. As shown in FIG. 7, the recess 98 includes parallel top and bottom edges 100 formed in an angled dovetail shape so that the side sections 80 can be secured on the curtain rod 102 in a friction fit relationship.

A corner recess 87 is provided in the top surface 92 of the side section and the front face 84 of the side section 80 at the first side surface 88. A similar corner recess 87 is provided in the bottom surface 94 and the front face 84 of the side section 80 at the first side surface 88. Such corner recesses 87 are sized to accept corner pieces 10, as shown in FIGS. 1, 2 and 3, and described below, such that the corner pieces 10 do not extend past the plane of the front face 84, the top surface 92, or the bottom surface 94 of the side section 80. An advantage of the corner recesses 87 is to provide a smooth finished appearance to the exterior of the window cornice when fabric 110, as described below, is wrapped around the side section.

As shown best in FIGS. 2, 7A and 7B, the side section 80 has a hole 99 between the front face 84 and the rear face 86 so that once the side section is placed onto the curtain rod 102, such curtain rod may be accessed by the user without removal of the side section.

As discussed above in connection with the front section 60, the side sections 80 may include a series of parallel preweakened strips 96 which facilitate custom sizing of the window cornice assembly. In particular, the preweakened strips allow the length of the side sections 80 to be reduced so that, when attached to the front section 60, the distance that the front section 60 extends from the wall or window from on which it is attached may be adjusted to fit varying window and curtain sizes or to suit individual tastes.

In the preferred embodiments, the side sections may be made of the same material as the front section 60.

Corner pieces 10 are illustrated in FIGS. 1–3 for attaching the front section 60 to the side sections 80. Each comer piece includes a support member 12 having a plurality of integral spikes 24 extending upwardly and perpendicularly to the support member 12 terminating with the pointed end spaced from the support member. In use, the spikes 24 of a corner piece 10 are placed on either the top surface 70 or the bottom surface 72 of the front section and the respective top surface 92 or the bottom surface 94 of one of the side sections 80 and are then pushed into such surfaces so that the front and side sections are held together.

As also shown in FIGS. 1–3, the support member 12 of the 14 corner piece 10 may be flat and may have an L-shape to conform to a perpendicular arrangement of the side section 80 to the front section 60 as is often found in installed window cornices. However, it should be appreciated that the corner piece 10 may be formed at various angles to facilitate the connection between the front section 60 and a corresponding side section 80 at desired additional angles such as an angle greater or less than ninety degrees.

In a preferred embodiment the corner piece 10 has a first side 18 attached perpendicularly to one end thereof and an opposing second side 20 attached perpendicularly to another end thereof. The first and second sides thus form a channel 22 with the spikes 24 extending parallel to and between the first and second sides 18 and 20. It should be appreciated that the sides 18 and 20 add stability to the corner piece.

The channel 22 formed by the first and second sides 18 and 20 may by sized to fit snugly onto the opposing front and rear faces 62 and 64 of the front section 60 and the corresponding front and rear faces 84 and 86 of the side section 80. Adapting the width of the channel 22 to fit snugly onto the front and side sections 60 and 80 allows the corner piece to more securely hold these two sections together.

It should be appreciated that the corner piece 10 may be fashioned from a variety of materials. In a preferred embodiment, the corner piece is made of a polymeric material and may be integrally formed by injection molding or the like. In alternate embodiments, the corner piece 10 may be made of separate connected components.

One important advantage obtained by the novel and unobvious structure of the corner piece 10 is that it can be easily placed in assembled position without external securing accessories such as nails, adhesives and the like.

If desired, multiple corner pieces can be used to more securely hold one or both of the side sections 80 to the front section 60. For example, as shown in FIG. 2, the window cornice assembly 1 includes four corner pieces 10 used to secure the two side sections 80 to the front section 60. In particular, a first corner piece 10 is arranged on the top surface 70 of the front section 60 and the top surface 92 of a first side section 80. A second corner piece 10 is arranged on the top surface 70 of the front section 60 and the top surface 92 of a second side section 80. Third and fourth corner pieces 10 are arranged on the bottom surface 72 of the front section 60 and the bottom surface 94 of the corresponding first and second side sections 80.

Another aspect of the present invention relates to the use of one or more support strips 26 to add stability to the front section 60, as shown in FIGS. 1, 2, 4 and 9. The support strip 26 is arranged on either or both of the top surface 70 or the bottom surface 72 of the front section 60.

In one preferred embodiment, the support strip 26 is channel-shaped. As particularly shown in FIG. 4, the support strip 26 has a central support member 28 and a pair of opposing and parallel side members 34 and 36 arranged at opposite ends of the central support member 28 and extending perpendicular thereto.

A channel 38 is formed between the first and second sides 34 and 36 and the central support member 28. The channel 38 may be sized to fit snugly onto the front and rear faces 62 and 64 at the top of the front section 60. In a preferred embodiment, in order to allow the support strip 26 to fit snugly onto the front section 60, the central support member 26 is bowed outward thereby causing the first and second side, 34 and 36 to be angled towards each other. This arrangement allows the support strip to provide more stability to the front section 60. The support strip 26 is particularly beneficial when used with an adjustable cornice assembly made out of a foam material where increased stability is desirable. In addition, in the embodiment of the present invention having an adjustable front section 60 with preweakened sections 74, the support strip provides a smooth surface over which fabric can be easily pulled.

It should be appreciated that the support strip 26 may be fashioned from a variety of materials. In a preferred embodiment, the support strip is made of a polymeric material and may be integrally formed by injection molding or the like. In alternate embodiments, the support strip 26 may be made of connected components.

In accordance with another novel and unobvious aspect of the present invention, the window cornice assembly 1 includes fabric clips 40 to secure fabric or other flexible material 110 over the front and side sections thereof. This aspect of the present invention is best shown in FIGS. 2, 5A, 5B and 5C.

Figure 5A:
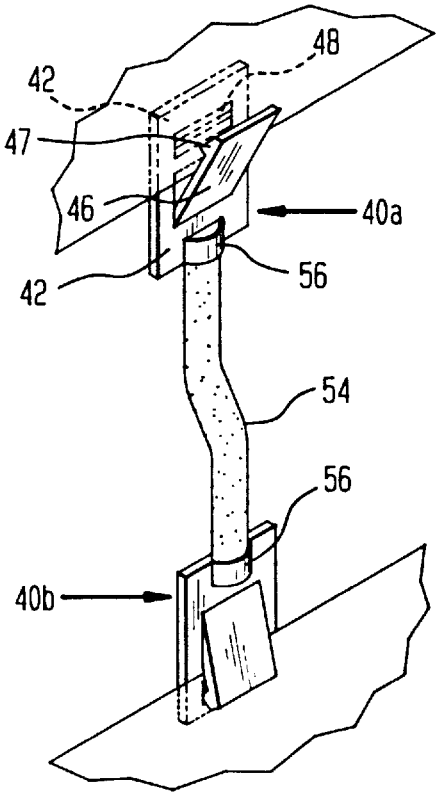
FIG. 5A is a perspective view of one embodiment of two removable corner clips assembled on a fabric web connected by an elastic cord.

FIG. 5A shows one embodiment of the fabric clip wherein two clips 40*a* and 40*b* are attached to each other by an elastic cord 54, commonly known as a Bungee cord, or some other similar elastic cord or fabric. In this embodiment, each end of the elastic cord 54 is attached to a fabric clip at a connecting point 56. Each clip 40*a* and 40*b* includes a clip portion 42 having a hinge member 46, a hinge tab 47 and a catch member 48. To attach the fabric clips 40*a* and 40*b* to the fabric 110, the fabric 110 is placed between the hinge member 46 and the catch member 48 and then the hinge member is pressed towards the catch member until the hinge tab 47 is secured within the hinge catch. This releasably secures the fabric 110 to the fabric clip 40.

As shown in FIG. 1, to arrange fabric 110 on the window cornice, the fabric 110 is arranged on the front face 62 of the front section 60 and the front face 84 of each respective side section 80 and the first end 112 of the fabric 110 is draped over the top surface 70 of the front section 60 such that the first end 112 of the fabric 110 is arranged adjacent to the rear face 64 of the front section 60. The second end 114 of the fabric 110 is wrapped around the bottom surface 72 of the front section 60 such that second end 114 of the fabric 110 is arranged adjacent to the rear face 64 of the front section 60. The first end 112 of the fabric 110 may also be arranged on the front face 84 of each respective side section 80 and draped over the top surface 92 thereof such that the first end 112 of the fabric 110 is also arranged adjacent to the rear face 86 of each respective side section. Similarly, the second end 114 of the fabric 110 is wrapped around the bottom surface 94 of each respective side section 80 and arranged adjacent to the rear face 86 thereof.

With continued reference to FIG. 5A, one fabric clip 40*a* may be attached to the first end 112 of the fabric 110 and a second fabric clip 40*b*, may be attached to the second end 114 of the fabric. The fabric clips 40*a* and 40*b* may be attached to each other by a Bungee or other elastic cord, thus securing the first and second ends of the fabric to the rear faces of the respective front and side sections. Connecting the two ends of the fabric together adjacent to the rear face of the respective front and side sections by fabric clips joined by an elastic cord allows the fabric to be held tightly to the front and side sections. This arrangement also imparts a degree of flexibility to the fabric, allowing the fabric to be held to the front and side sections without wrinkles despite changes in temperature, humidity, or with eventual stretching of the fabric over time. An additional advantage of this embodiment is that by releasing the fabric clips 40*a* and 40*b* from the fabric 110, the fabric may be removed from the window cornice to be cleaned or replaced without removal of the window cornice from above the window.

Figure 5C:
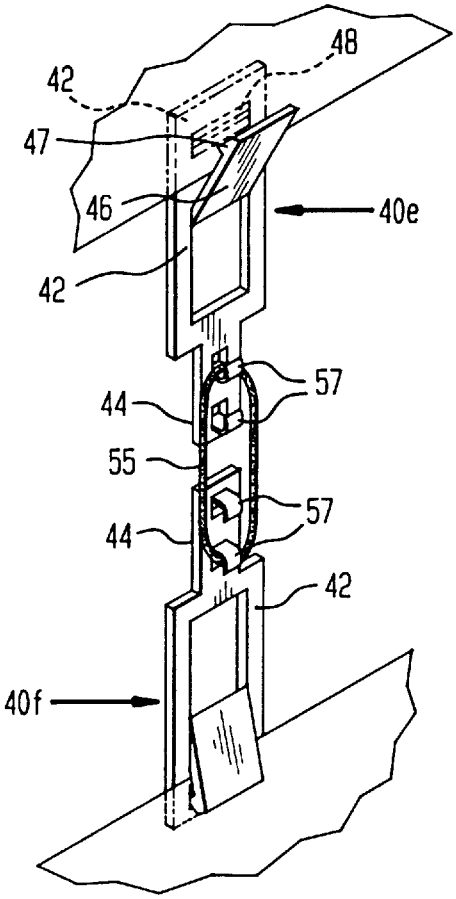
FIG. 5C is a perspective view of another embodiment of a pair of corner clips which employ an elastic band to connect the two clips.
Figure 5B:
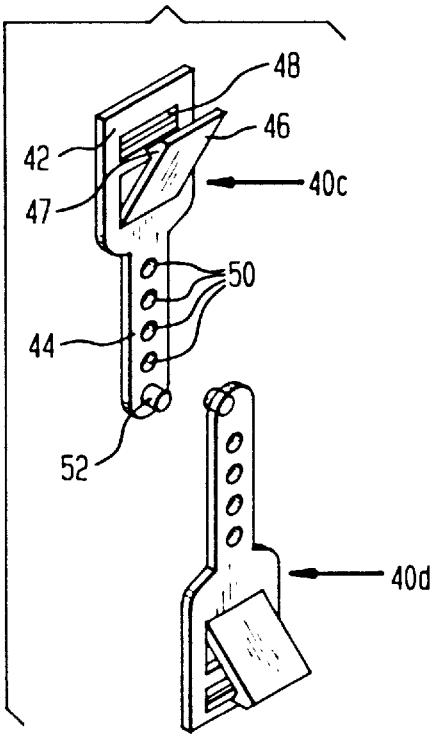
FIG. 5B is a perspective view of another embodiment of a pair of corner clips which do not require use of the elastic cord shown in FIG. 5A.

FIG. 5B shows another preferred embodiment of the fabric clip wherein each fabric clip 40*c* and 40*d* has a clip portion 42 for attaching fabric to the fabric clip and a means for connecting two fabric clips to each other. The clip portion 42 includes a hinge member 46, a hinge tab 47 and a hinge catch 48 to secure fabric to the fabric. In one preferred embodiment of this type of fabric clip, the means for connecting two fabric clips together is a connecting member 44 having a series of holes 50 and a protrusion 52. In this embodiment, the fabric clips 40*c* and 40*d* are secured together by disposing the protrusion 52 of each fabric clip 40*c* and 40*d* into a matching hole 50 of the other fabric clip 40*d* and 40*c*.

In arranging the fabric 110 on the front face 62 of the front section 60 and the front face 84 of each respective side section 80, the first end 112 of the fabric 110 is draped over the top surface 70 of the front section 60 such that the first end 112 of the fabric 110 is arranged adjacent to the rear face 64 of the front section 60. The second end 114 of the fabric 110 is wrapped around the bottom surface 72 of the front section 60 such that second end 114 of the fabric 110 is arranged adjacent to the rear face 64 of the front section 60. The first end 112 of the fabric 110 may also be arranged on the front face 84 of each respective side section 80 and draped over the top surface 92 thereof such that the first end 112 of the fabric 110 is also arranged adjacent to the rear face 86 of each respective side section. Similarly, the second end 114 of the fabric 110 is wrapped around the bottom surface 94 of each respective side section 80 and is arranged adjacent to the rear face 86 thereof.

With confirmed reference to FIG. 5B, the first end 112 of the fabric 110 may then be attached to the clip portion 42 of one fabric clip 40*c* and the second end 114 of the fabric 110 may be attached to the clip portion 42 of a second fabric clip 40*d*. Fabric clips 40*c* and 40*d* are secured to each other at the respective connecting members 44 of each respective fabric clip, thereby securing the fabric 110 to the window cornice.

An advantage of this embodiment is that by selecting the holes 50 on the respective fabric clips 40*c* and 40*d* in which the protrusions 52 are disposed, the fabric clips can be fit together so that the fabric clip portions are situated away from each other at a desired distance. This allows the fabric clips to be used to adjust to the size of the fabric and the window cornice, thereby increasing the aesthetics of the window cornice. This embodiment also allows the fabric to be rearranged on the front section by repositioning the connection between the two fabric clips, thereby accounting for stretching of the fabric over time or with changes in humidity and temperature. This embodiment also allows the fabric to be removed from the window cornice to be cleaned and replaced without removal of the window cornice from above the window.

FIG. 5C shows another preferred embodiment of the fabric clip wherein each fabric clip 40*e* and 40*f* has a clip portion 42 for attaching fabric to the fabric clip and an elastic band or other means for connecting two fabric clips to each other. The clip portion 42 includes a hinge member 46, a hinge tab 47 and a hinge catch 48 to secure fabric to the fabric. An elastic band 55 may be attached to respective hooks 57 on fabric clips 40*e* and 40*f* to secure the fabric clips together.

In arranging the fabric 110 on the front face 62 of the front section 60 and the front face 84 of each respective side section 80, the first end 112 of the fabric 110 is draped over the top surface 70 of the front section 60 such that the first end 112 of the fabric 110 is arranged adjacent to the rear face 64 of the front section 60. The second end 114 of the fabric 110 is wrapped around the bottom surface 72 of the front section 60 such that second end 114 of the fabric 110 is arranged adjacent to the rear face 64 of the front section 60. The first end 112 of the fabric 110 may also be arranged on the front face 84 of each respective side section 80 and draped over the top surface 92 thereof such that the first end 112 of the fabric 110 is also arranged adjacent to the rear face 86 of each respective side section. Similarly, the second end 114 of the fabric 110 is wrapped around the bottom surface 94 of each respective side section 80 and is arranged adjacent to the rear face 86 thereof.

With continued reference to FIG. 5C, the first end 112 of the fabric 110 may then be attached to the clip portion 42 of one fabric clip 40*e* and the second end 114 of the fabric 110 may be attached to the clip portion 42 of a second fabric clip 40*f*. The fabric clips 40*e* and 40*f* are then secured to each other by an elastic band 55 that connects to attachment hooks 57 on each of the fabric clips 40*e* and 40*f*. The fabric 110 is releasably attached to the fabric clips at the clip portion 42 by arranging an end of the fabric between the hinge member 46 and the catch member 48 and then the pressing the hinge member towards the catch member 48 until the hinge tab 47 is secured within the catch member 48. This releasably secures the fabric 110 to the fabric clip 40 thereby securing the fabric 110 on the window cornice.

An additional advantage of this embodiment is that by releasing the elastic band 55 from either or both of the fabric clips 40*e* and 40*f*, the fabric may be removed from the window cornice to be cleaned or replaced without removal of the window cornice from above the window.

In addition, in this preferred embodiment, each of the fabric clips 40*e* and 40*f* are provided with multiple attachment hooks 57 for attachment of the elastic band 55, each such attachment hook 57 being increasingly distal to the clip portion 42 of the fabric clip 40*e* or 40*f*. The distance between which the fabric clips are attached to each other can be thus adjusted by selecting different hooks 57 on which the elastic band is secured. This adjustment feature allows the fabric clips to be used to fasten the fabric 110 tightly around the front section 60 and side section 80 of the cornice according to individual preference. This embodiment also allows the fabric to be rearranged on the front section by repositioning the elastic band on the two fabric clips, thereby accounting for stretching of the fabric over time or with changes in humidity and temperature.

Other means for connecting two fabric clips together include catches, prongs, rings, hooks and eyes, Velcro-type mechanisms, and the like. Although FIGS. 5A, 5B and 5C show variations of the fabric clips, 40*a*–40*f*, it should be appreciated that the specific structure of the fabric clips may vary in alternate embodiments. Further, the arrangement of the fabric clips adjacent to the rear face of the front or side sections of a window cornice may vary in alternate embodiments of the present invention. For example, the fabric clips may be secured directly to the rear face of the cornice sections.

It should be appreciated that various modifications to the foregoing description of the preferred embodiments can be made and indeed, are encouraged to be made, without departing from the scope of the present invention, which is set forth in the following claims.

We claim:

1. A window cornice assembly comprising:

a front section made of foam and having an elongate body defining opposing first and second ends and including a front face, first and second side surfaces arranged at said opposing first and second ends of said body, and opposing top and bottom surfaces extending between said first and second ends substantially transverse to said first and second side surfaces;

first and second side sections made of foam, each having an elongate body defining opposing first and second ends and including a front face, first and side surfaces arranged at said opposing first and second ends of said body, and opposing top and bottom surfaces extending between said first and second ends substantially transverse to said first and second side surfaces, said first side section being connected to said front section at said first end thereof, and said second side section being connected to said front section at said second end thereof, wherein said front section and said first and second side sections include a rear face opposite respective ones of each said front face, said rear face of said front section having an elongate recess therein extending between said first and second ends; and further comprising a curtain rod, said front section being arranged on said curtain rod at said elongate recess to form a friction fit connection;

at least one L-shaped corner piece including a central support member and first and second side members extending substantially parallel to each other and substantially perpendicular to said central support member, said first side member integrally attached at said first end of said central support member, and said second side member integrally attached at second end of said central support member, thereby forming a channel-shaped corner piece, and a plurality of spikes extending downwardly from said central support member, said plurality of spikes extending into said top surface of said front section and one of said first or second side sections; and fabric arranged over said front section, said first and second side sections and said at least one corner piece when said window cornice assembly is fully assembled.

2. The window cornice assembly of claim 1 wherein said at least one corner piece includes a plurality of corner pieces, one of said corner pieces being connected to said front section and said first side section, and one of said corner pieces being connected to said front section and said second side section.

3. The window cornice assembly of claim 1 wherein each of said rear face of said first and second side sections include a recess therein extending between said first and second ends, said recesses of said first and second side sections being substantially aligned with each other and continuous with said elongate recess of said front section, said first and second side sections and said front section being arranged on said curtain rod at said elongate recess of said first section and said recesses of said first and second sections to form a friction fit connection.

4. The window cornice assembly of claim 1 wherein said at least one corner piece comprises an integral polymeric piece.

5. The window cornice assembly of claim 1 wherein said front section includes a recess at one or both of said opposing first and second ends, said at least one corner piece being arranged in said recess.

6. The window cornice assembly of claim 1 wherein one or both of said first and second side sections includes a recess at one of said opposing first and second ends thereof, said at least one corner piece being arranged in said recess.

7. A window cornice assembly comprising:

a front section made of foam and having an elongate body defining opposing first and second ends and including a front face, first and second side surfaces arranged at said opposing first and second ends of said body, and opposing top and bottom surfaces extending between said first and second ends substantially transverse to said first and second side surfaces;

first and second side sections made of foam, each having an elongate body defining opposing first and second ends and including a front face, first and side surfaces arranged at said opposing first and second ends of said body, and opposing top and bottom surfaces extending between said first and second ends substantially transverse to said first and second side surfaces, said first side section being connected to said front section at said first end thereof, and said second side section being connected to said front section at said second end thereof, wherein said front section and said first and second side sections include a rear face opposite respective ones of each said front face, said rear face of said front section having an elongate recess therein extending between said first and second ends; and further comprising a curtain rod, said front section being arranged on said curtain rod at said elongate recess to form a friction fit connection;

at least one channel-shaped corner piece having an L-shaped configuration and including a support member, and a plurality of spikes extending therefrom, and a pair of opposing side members in spaced relation to each other and extending substantially perpendicular to said support member, said plurality of spikes of each of said at least one corner piece extending into said top surface of said front section and said top surface of said first or second side sections; and fabric arranged over said front section, said first and second side sections and said at least one corner piece when said window cornice assembly is fully assembled.

8. The window cornice assembly of claim 7 wherein said at least one channel-shaped corner piece includes a plurality of channel-shaped corner pieces, one of said channel-shaped corner piece being connected to said front section and said first side section, and one of said channel-shaped corner piece being connected to said front section and said second side section.

9. The window cornice assembly of claim 7 wherein each of said rear face of said first and second side sections include a recess therein extending between said first and second ends, said recesses of said first and second side sections being substantially aligned with each other and continuous with said elongate recess of said front section, said first and second side sections and said front section being arranged on said curtain rod at said elongate recess of said first section and said recesses of said first and second sections to form a friction fit connection.

10. The window cornice assembly of claim 7 wherein said at least one corner piece comprises an integral molded polymeric piece.

11. The window cornice assembly of claim 7 wherein said front section includes a recess at one or both of said opposing first and second ends, said at least one corner piece being arranged in said recess.

12. The window cornice assembly of claim 7 wherein one or both of said first and second side sections includes a recess at one of said opposing first and second ends thereof, said at least one corner piece being arranged in said recess.

13. A window cornice assembly comprising:

a foam u-shaped support structure adapted to be arranged above a window, said u-shaped support structure comprising a front section, and first and second side sections, wherein said front section and said first and second side sections include a rear face, said rear face of said front section having an elongate recess therein extending between said first and second ends; and further comprising a curtain rod, said front section being arranged on said curtain rod at said elongate recess to form a friction fit connection;

at least one channel-shaped corner piece having an L-shaped configuration and including a support member and a plurality of spikes extending therefrom, and a pair of opposing side members in spaced relation to each other and extending substantially perpendicular to said support member, said plurality of spikes extending into said front section and one of said first or second side sections; and fabric arranged over said front section, said first and second side sections and said at least one corner piece when said window cornice assembly is fully assembled.

14. The window cornice assembly of claim 13 wherein said at least one corner piece includes a plurality of corner pieces, one of said corner pieces being connected to said front section and said first side section, and one of said corner pieces being connected to said front section and said second side section.

15. The window cornice assembly of claim 13 wherein said at least one corner piece comprise an integral single molded polymeric piece.

16. The window cornice assembly of claim 13 wherein said front section of said u-shaped support structure includes a recess, said at least one corner piece being arranged in said recess.

17. The window cornice assembly of claim 13 wherein one or both of said first and second side sections of said u-shaped support structure includes a recess, said at least one corner piece being arranged in said recess.

* * * * *